US011718939B2

(12) United States Patent
Gupta

(10) Patent No.: US 11,718,939 B2
(45) Date of Patent: Aug. 8, 2023

(54) DOUBLE NEEDLE THREADER

(71) Applicant: DPG USA Inc., Schaumburg, IL (US)

(72) Inventor: Nikhil Gupta, Schaumburg, IL (US)

(73) Assignee: DPG USA INC., Schaumburg, IL (US)

( * ) Notice: Subject to any disclaimer, the term of this patent is extended or adjusted under 35 U.S.C. 154(b) by 0 days.

(21) Appl. No.: 17/581,886

(22) Filed: Jan. 22, 2022

(65) Prior Publication Data

US 2022/0145505 A1 May 12, 2022

Related U.S. Application Data

(63) Continuation-in-part of application No. 16/936,497, filed on Jul. 23, 2020.

(60) Provisional application No. 63/281,762, filed on Nov. 22, 2021, provisional application No. 62/878,580, filed on Jul. 25, 2019.

(51) Int. Cl.
*D05B 87/00* (2006.01)

(52) U.S. Cl.
CPC ..... *D05B 87/00* (2013.01)

(58) Field of Classification Search
CPC ..... D05B 87/00; B26B 27/00; B26B 29/00; A01K 97/04
USPC ..... D22/149
See application file for complete search history.

(56) References Cited

U.S. PATENT DOCUMENTS

| | | | | | |
|---|---|---|---|---|---|
| 1,239,270 | A * | 9/1917 | Hawkes | D05B 87/00 | 223/99 |
| 1,261,271 | A * | 4/1918 | Myers | D05B 87/00 | 160/404 |
| 2,679,959 | A * | 6/1954 | Ullisperger, Sr. | D05B 87/00 | 108/69 |
| 2,747,778 | A * | 5/1956 | Balzer | D05B 87/00 | 112/225 |
| 2,757,837 | A * | 8/1956 | Dritz | D05B 87/00 | 223/99 |
| 4,838,426 | A * | 6/1989 | Dalbo | D05B 87/00 | 211/DIG. 1 |
| 5,283,920 | A * | 2/1994 | Plummer | A01K 97/00 | 7/106 |

* cited by examiner

*Primary Examiner* — Ismael Izaguirre
(74) *Attorney, Agent, or Firm* — Dunlap Bennett & Ludwig, PLLC; Anna L. Kinney

(57) ABSTRACT

A double needle threader, includes an elongate graspable body having a pair of threading ledges formed thereupon, including a first threading ledge and a second threading ledge, a pair of threading apertures including a first threading aperture and a second threading aperture extending through said threading ledges, a pair of ridges including a first ridge and a second ridge formed adjacent said threading apertures, said ridges each having a collapsible wire loops, including a first wire loop and a second wire loop projecting therefrom extending over said threading apertures, said wire loops each having a generally angular return bend formed therein, said wire loops being configured to be passable through the eye of a needle, wherein the threading loops are of different sizes, the first wire loop being coarser than the second wire loop so that the first wire loop accommodates larger needles and sewing machines, while the second wire loop has a finer wire for smaller needles.

20 Claims, 10 Drawing Sheets

DOUBLE NEEDLE THREADER

CLAIM FOR PRIORITY

This application is a continuation-in-part of co-pending U.S. patent application Ser. No. 16/936,497, filed Jul. 23, 2020. Application Ser. No. 16/936,497 was based on U.S. Provisional Application No. 62/878,580, filed Jul. 25, 2019. This application is also based on U.S. Provisional Patent Application No. 63/281,762, filed Nov. 22, 2021. The priority of the foregoing applications is hereby claimed and their disclosures incorporated herein by reference.

BACKGROUND

Sewing has been accomplished using needle and thread for thousands of years, yet a perplexing issue remains to trouble those who merely wish to take a first step into sewing—passing the thread through the eye of the needle. As technology for forming needles has advanced and finer needles and finer threads are used for sewing, the difficulty of threading the needle has increased, so that even those with quite good vision and good coordination will often require more than one pass to achieve a threaded needle.

A variety of devices have been developed often involving various permutations of magnifying lenses, auxiliary lighting, grasping devices and intermediary devices for holding the needle or thread to ease the critical step of introducing the thread into the eye of the needle. Of course, magnifying lenses are subject to scratching and Murphy's law suggests that battery power for auxiliary lighting will generally fail when most needed while larger devices will tend not to find a permanent home in the sewing bag as they can become inconveniently large considering everything else that we all too often find it necessary to carry.

So also, needles and threads are sized differently depending on the application, and there is a need to accommodate different size needles and threads without requiring multiple devices that can easily be misplaced.

SUMMARY OF THE INVENTION

The device of the present invention addresses the foregoing problems by providing a compact device which requires neither magnification nor auxiliary lighting and can conveniently be carried in even the smallest of sewing bags. Moreover, the device of the present invention provides 2 different size threading loops in a single device.

In particular, the shortcomings of the prior art are addressed by providing a double needle threader having: an elongate graspable body with generally planar threading ledges formed adjacent each end of the elongate graspable body, a threading aperture extending through each threading ledge, a pair of ridges formed adjacent the threading apertures, each ridge having a collapsible wire loop projecting therefrom extending over said threading aperture, the ridges being medially disposed in the graspable body, the graspable body comprising a thickened portion between the ridges, the wire loops having a generally angular return bend formed therein. Preferably, a pair of grasping depressions are formed on opposed surfaces of the graspable body, the grasping depressions being formed in the thickened portion of the body disposed between the ridges. The various features of the double needle threader are illustrated in FIGS. 1 through 20D.

BRIEF DESCRIPTION OF THE DRAWINGS

The invention is described in detail below with reference to the drawings, wherein like numerals designate similar parts and wherein:

FIGS. 1-17 are to scale.

DETAILED DESCRIPTION

Figure 1:
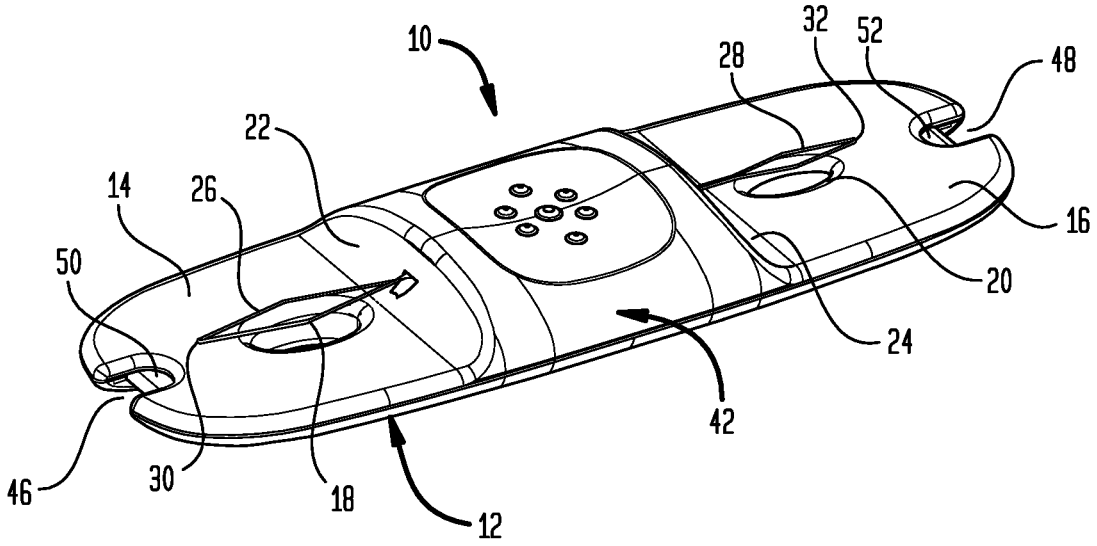
FIG. 1 is a perspective top view of the inventive Double Needle Threader of the present invention.
Figure 2:
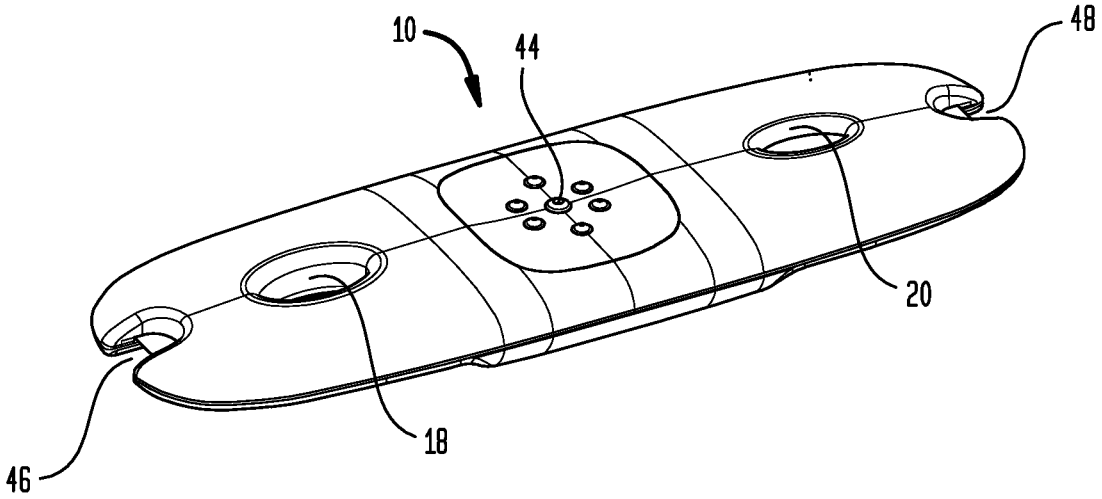
FIG. 2 is a bottom perspective view of the Double Needle Threader of FIG. 1.
Figure 3:
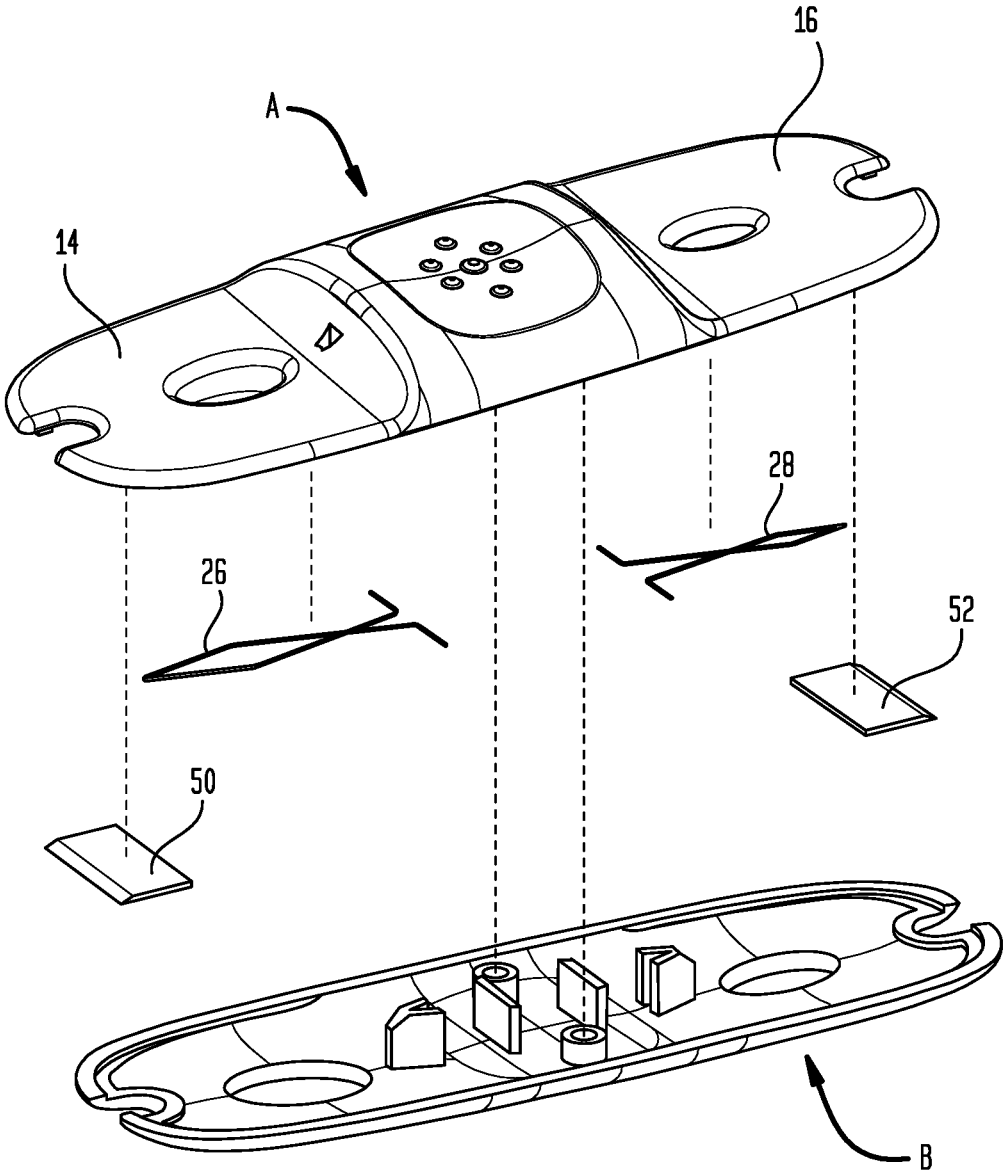
FIG. 3 is an exploded view showing the various parts of the Double Needle Threader of FIGS. 1 and 2.
Figure 4:
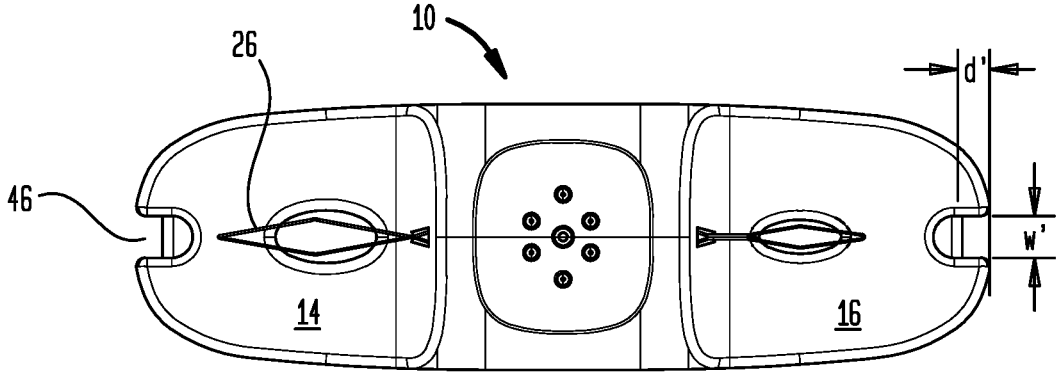
FIG. 4 is a top plan view of the Double Needle Threader of FIGS. 1 and 2.
Figure 5:
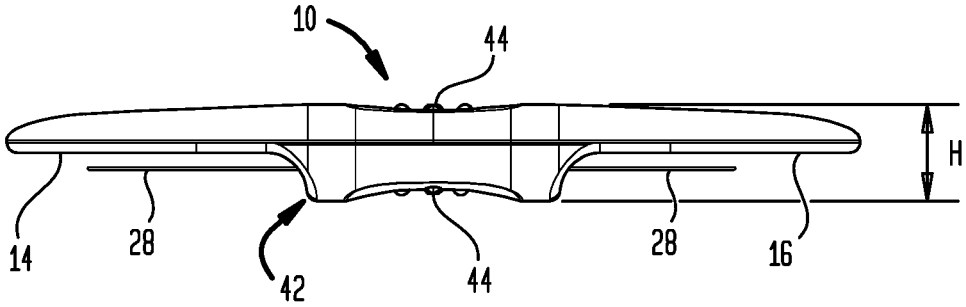
FIG. 5 is a side view in elevation of the Double Needle Threader of FIGS. 1, 2 and 4.
Figure 6:
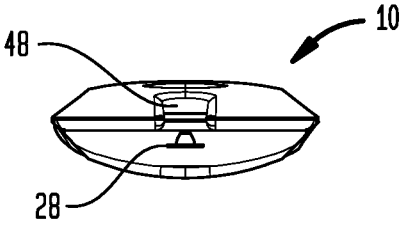
FIG. 6 is an end view in elevation of the Double Needle Threader of FIG. 5.
Figure 7:
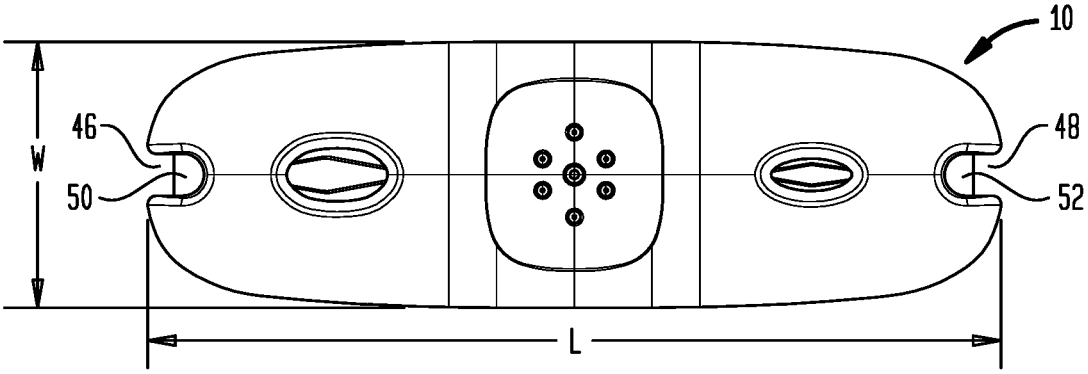
FIG. 7 is a bottom plan view of the Double Needle Threader of FIGS. 1, 2, 4, 5 and 6.
Figure 8:
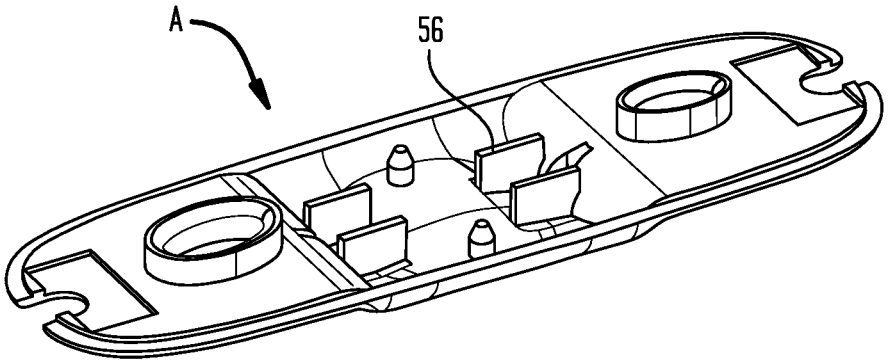
FIG. 8 is a bottom perspective view of an upper member for forming the Double Needle Threader.
Figure 9:
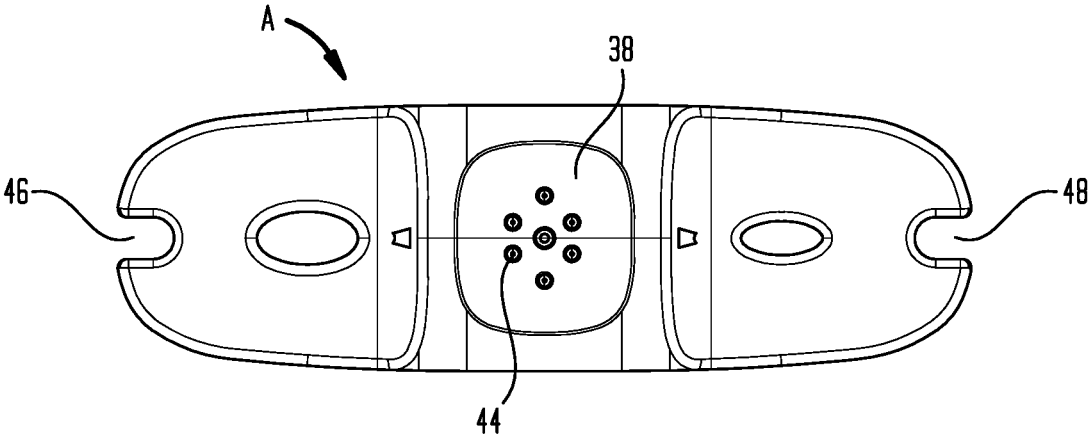
FIG. 9 is a top plan view of the forming member of FIG. 8.
Figure 10:
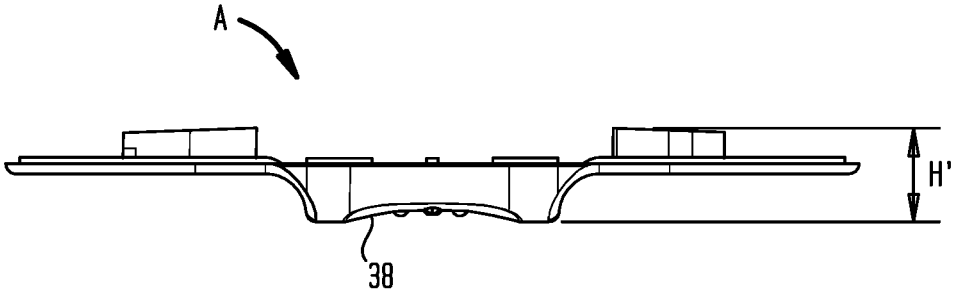
FIG. 10 is a side view in elevation of the forming member of FIGS. 8 and 9.
Figure 11:
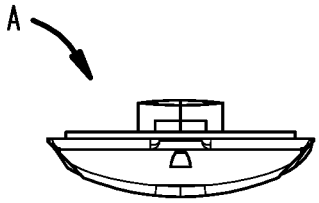
FIG. 11 is an end view in elevation of the forming member of FIGS. 8, 9 and 10.
Figure 12:
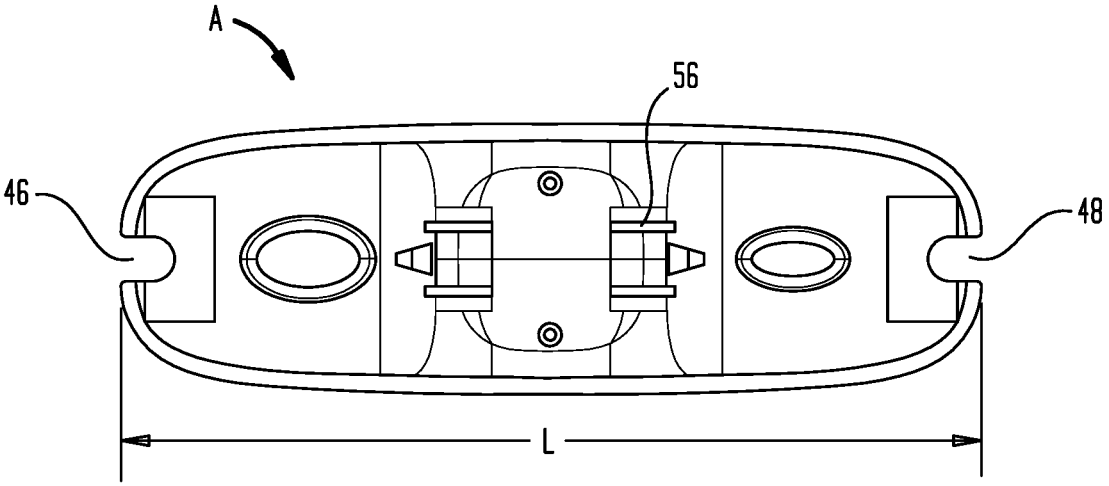
FIG. 12 is a bottom plan view of the forming member of FIGS. 8 to 11.
Figure 13:
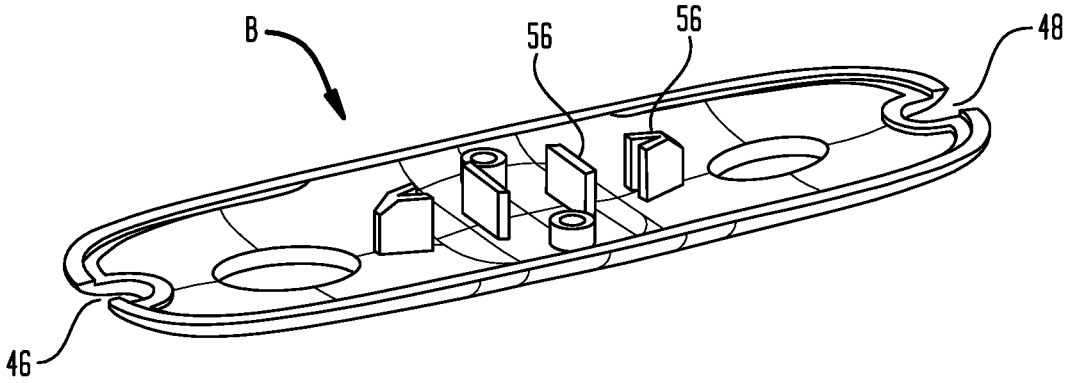
FIG. 13 is a top perspective view of a lower member for forming the Double Needle Threader of FIGS. 1 to 7.
Figure 14:
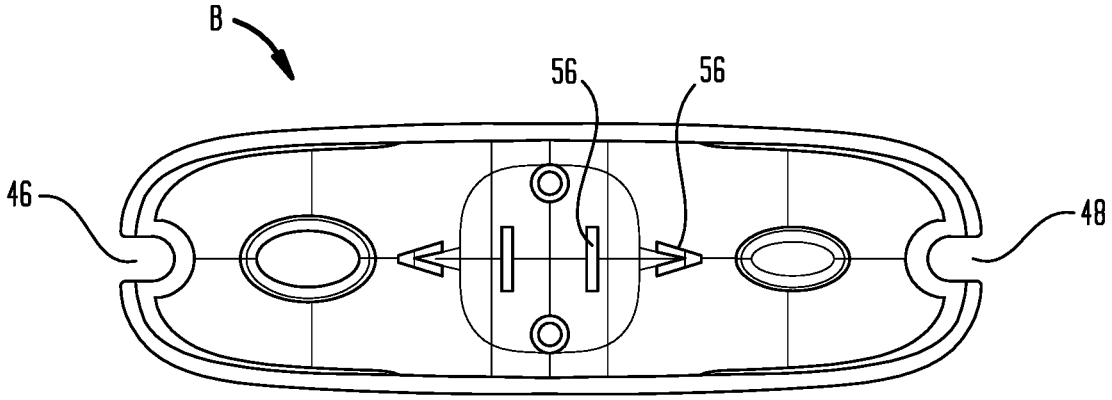
FIG. 14 is a top plan view of the lower forming member of FIG. 13.
Figure 15:
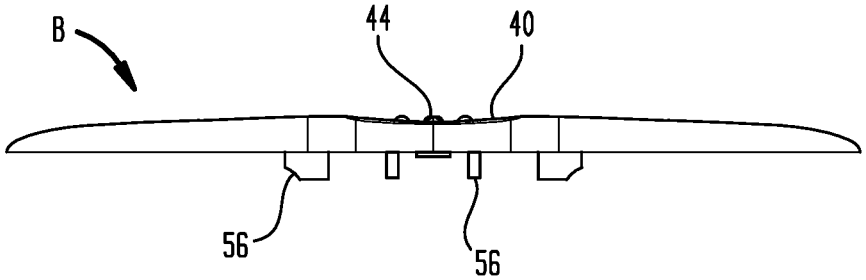
FIG. 15 is a side view in elevation of the lower forming member of FIGS. 13 and 14.
Figure 16:
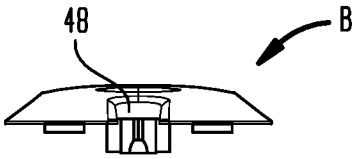
FIG. 16 is an end view in elevation of the lower forming member of FIGS. 13 to 15.
Figure 17:
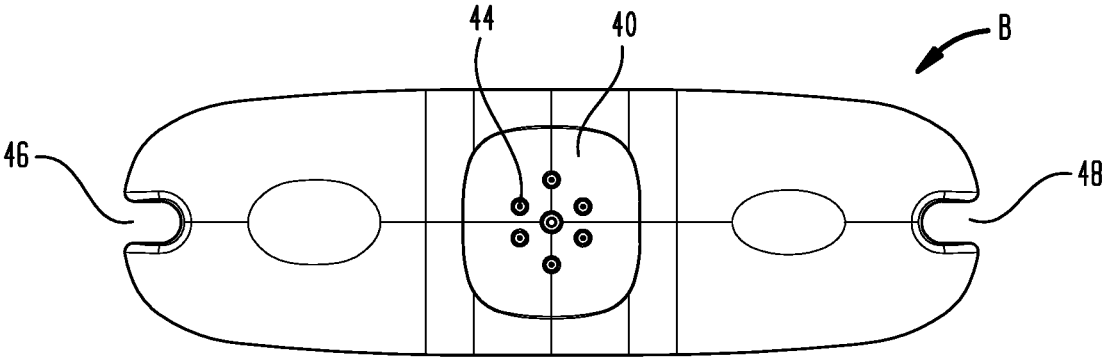
FIG. 17 is a bottom plan view of the lower forming member of FIGS. 13 to 16.
Figure 18:
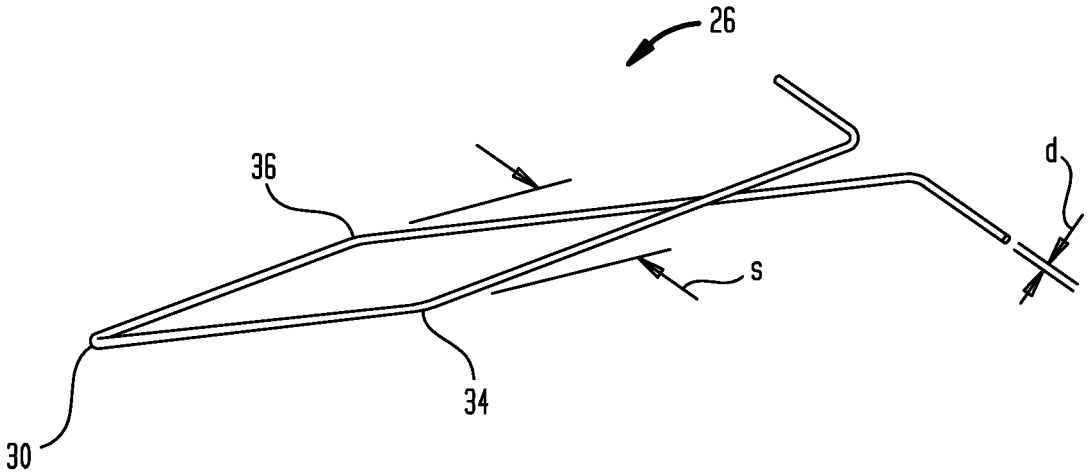
FIG. 18 is a perspective diagram of wire threading loops used in connection with the invention.

The device of the present invention is illustrated in FIGS. 1 through 20D, wherein in it is seen the device has a double-ended structure with a threading ledge on each end with a threading aperture and a pair of diamond shaped wire threading loops and terminal cutting blades as shown. Adjacent the threading ledge are a pair of ridges which transition to a thickened central portion which may have one or more gripping depressions with grip enhancing surfaces as illustrated. The threading loops are of different sizes, one coarser than the other for larger needles and sewing machines, while the smaller loop has a finer wire for smaller needles. The coarser loop may have a wire diameter of from about 0.12 mm to about 0.15 mm, suitably about 0.125 mm while the finer loop may have a wire diameter of from about 0.075 mm to about 0.11 mm, suitably about 0.10 mm.

The graspable body and threading ledges are suitably colored to enhance visibility of the eye of the needle, the threading loops, and the thread. I have found that the increased contrast is particularly beneficial to seamstresses and tailors of more advanced age, since the very small dimensions involved tend to overtax eyesight. Blue is the most effective color, followed by white and lighter shades of green. The background of the threading ledge under the threading loop greatly enhances visibility and provides for quicker, more accurate threading of needles generally. Different size threading loops also provide for more accurate, fast threading of different size needles and/or different size threads without the need for a separate tool.

Referring more specifically to the Figures, there is illustrated a double needle threader 10, comprising: an elongate graspable body 12 having a pair of threading ledges formed thereupon, including first threading ledge 14 and a second threading ledge 16, a pair of threading apertures including a first threading aperture 18 and a second threading aperture 20 extending through said threading ledges, a pair of ridges including a first ridge 22 and a second ridge 24 formed adjacent said threading apertures, said ridges each having a collapsible wire loops, including a first wire loop 26 and a second wire loop 28 projecting therefrom extending over said threading apertures, said wire loops each having a generally angular return bend 30, 32 formed therein, said wire loops being configured to be passable through the eye of a needle, wherein the threading loops are of different sizes, first wire loop 26 being coarser than second wire loop 28 so that the first wire loop accommodates larger needles and sewing machines, while the second wire loop has a finer wire for smaller needles.

In a preferred embodiment, first wire loop 26 has a wire diameter d of from about 0.12 mm to about 0.15 mm, while second wire loop 28 has a wire diameter d of from about 0.075 mm to about 0.11 mm, suitably wherein the first wire loop has a wire diameter of about 0.125 mm, while the second wire loop has a wire diameter of about 0.10 mm.

The wire loops typically have a diamond shape as illustrated, with a lateral span s between opposing sides 34, 36. First wire loop 26 may have a larger lateral span than second wire loop has a wire diameter of about 0.10 mm.

Generally, wire loops 26, 28 are comprised of stainless steel having a diameter of less than about 0.25 mm and may be formed of annealed stainless steel.

There also may be provided a pair of grasping depressions 38, 40 formed on opposed surfaces of said elongate graspable body.

Note that threading ledges 14, 16 are formed adjacent each end of said elongate graspable body and the ridges 22, 24 are medially disposed in said elongate graspable body; while graspable depressions 38, 40 are formed between said ridges. Typically, elongate graspable body 12 comprises a thickened portion 42 between said ridges, wherein graspable depressions 38, 40 are formed in thickened portion 42 of elongate graspable body 12 and may include grip enhancing protrusions indicated at 44.

The following features are also noted: threading ledges 14, 16 are generally planar; ridges 22, 24 extend substantially across the width of said elongate graspable body and adjoin the threading ledges and extend upwardly adjoining thickened portion 42 as shown.

Figure 19:
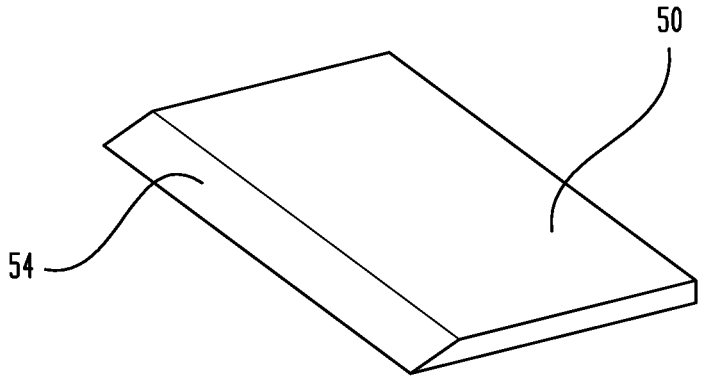
FIG. 19 is a perspective of cutting blades used in connection with the invention.

There is further provided a pair of cutting notches 46, 48 formed in each end of elongate graspable body 12, the notches having cutting blades 50, 52 disposed therein having a cutting edge 54 as shown in FIG. 19. As shown in the drawings, blades 50, 52 are recessed in cutting notches 46, 48 such that a human finger pressed against said cutting notch will not contact said blade. For example, wherein said cutting notches each have a width w' less than about 3 mm whilst said blade is spaced away from said periphery by a distance d' of at least 3 mm.

The inventive double needle threader is suitably formed by injection molding an upper forming member A and a lower forming member B from a thermoplastic material such as acrylonitrile/butadiene/styrene or the like with a plurality of assembly features indicated by the numeral 56 as well as the features noted above. When the various parts are assembled, double needle threader 10 has a length L of about 80 mm, a width W of about 25 mm and a height H of about 9 mm, while upper forming member A has a height H' of slightly less than 9 mm.

Figure 20A:
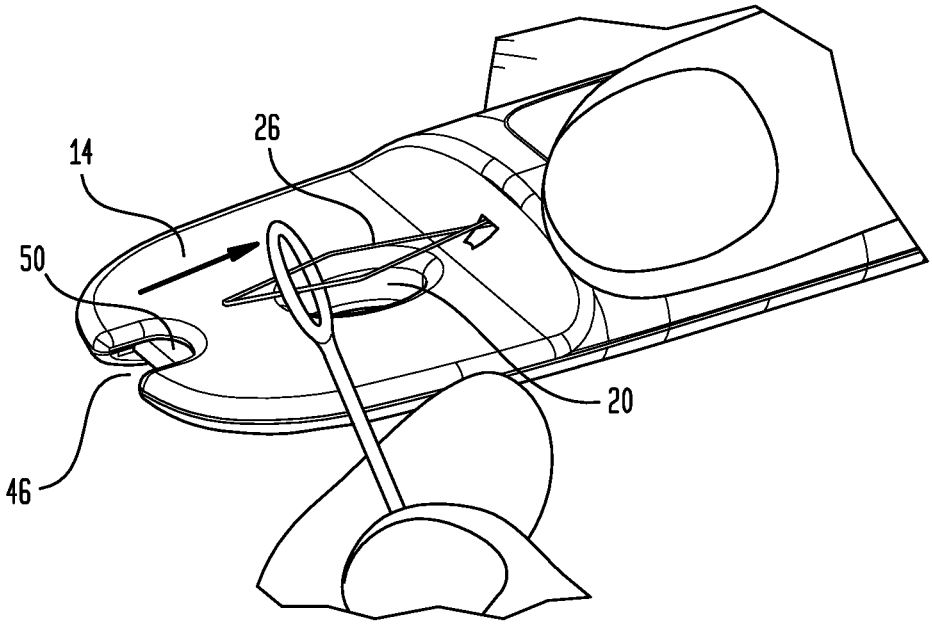
FIGS. 20A-20D are schematic diagrams illustrating operation of the Double Needle Threader.
Figure 20B:
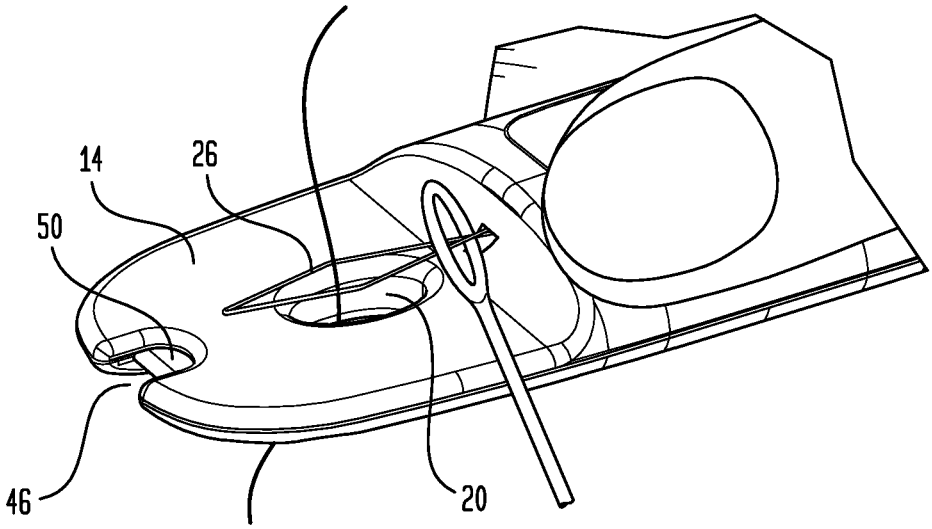
Figure 20C:
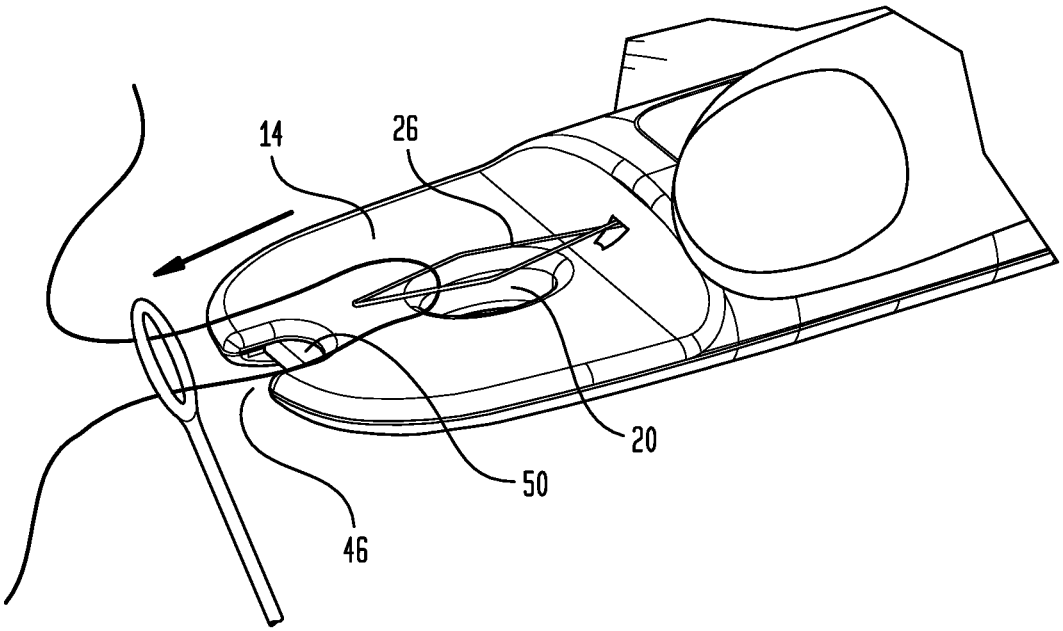
Figure 20D:
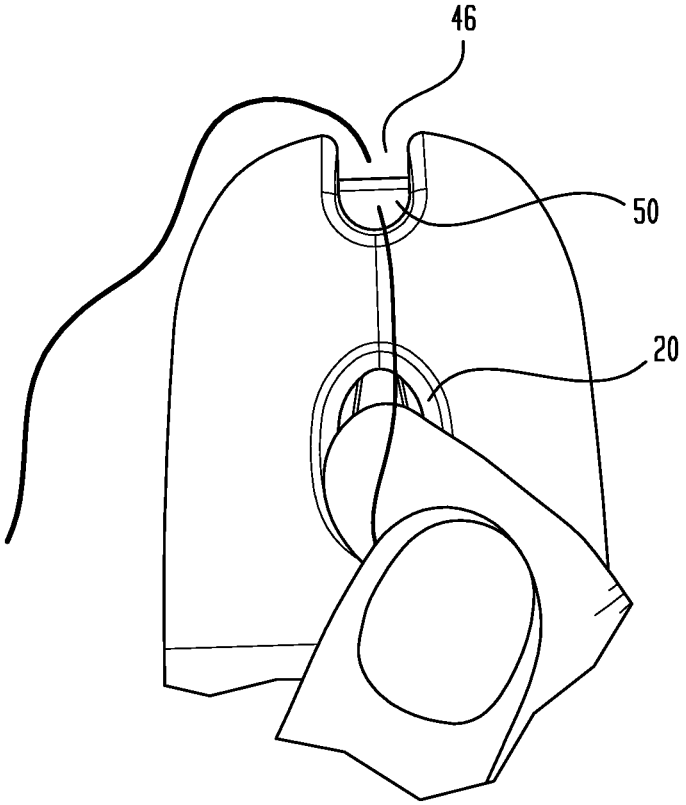

A needle is threaded and cut with either end of double needle threader 10 as indicated in FIGS. 20A to 20D. In FIG. 20A a sewing needle is passed over loop 26 toward ridge 22. Next, a thread is threaded through aperture 18 and loop 26 as shown in FIG. 20B. Then, the needle is withdrawn over loop 26 and threading of the needle is complete as shown in FIG. 20C. The thread is then conveniently severed as needed with blade 50 as is shown in FIG. 20D.

What is claimed is:

1. A double needle threader, comprising: an elongate graspable body having a pair of threading ledges formed thereupon, including a first threading ledge and a second threading ledge, a pair of threading apertures including a first threading aperture and a second threading aperture extending through said threading ledges, a pair of ridges including a first ridge and a second ridge formed adjacent said threading apertures, said ridges each having a collapsible wire loops, including a first wire loop and a second wire loop projecting therefrom extending over said threading apertures, said wire loops each having a generally angular return bend formed therein, said wire loops being configured to be passable through the eye of a needle, wherein the threading loops are of different sizes, the first wire loop being coarser than the second wire loop so that the first wire loop accommodates larger needles and sewing machines, while the second wire loop has a finer wire for smaller needles.

2. The double needle threader of claim 1, wherein said wire loops are comprised of stainless steel having a diameter of less than about 0.25 mm.

3. The double needle threader of claim 2, wherein said wire loops are comprised of annealed stainless steel having a diameter of less than about 0.25 mm.

4. The double needle threader of claim 1, wherein the first wire loop has a wire diameter of from about 0.12 mm to about 0.15 mm, while the second wire loop has a wire diameter of from about 0.075 mm to about 0.11 mm.

5. The double needle threader of claim 4, wherein the first wire loop has a wire diameter of about 0.125 mm, while the second wire loop has a wire diameter of about 0.10 mm.

6. The double needle threader of claim 1, wherein the wire loops have a diamond shape and the first wire loop has a larger lateral span than the second wire loop.

7. The double needle threader of claim 1, wherein the elongate graspable body and threading ledges are suitably colored to enhance visibility of the eye of the needle, the threading loops, and the thread.

8. The double needle threader of claim 7, wherein the elongate graspable body and threading ledges are colored blue, white or green.

9. The double needle threader of claim 1, wherein a pair of grasping depressions are formed on opposed surfaces of said elongate graspable body.

10. The double needle threader of claim 9, wherein the grasping depressions are provided with a plurality of grip enhancing protrusions.

11. The double needle threader of claim 1, wherein said threading ledges are formed adjacent each end of said elongate graspable body.

12. The double needle threader of claim 11, wherein said ridges are medially disposed in said elongate graspable body.

13. The double needle threader of claim 12, wherein said graspable depressions are formed between said ridges.

14. The double needle threader of claim 13, wherein said elongate graspable body comprises a thickened portion between said ridges, said grasping depressions being formed in said thickened portion of said elongate graspable body.

15. The double needle threader of claim 1, wherein said threading ledges are generally planar.

16. The double needle threader of claim 1, wherein said ridges extend substantially across the width of said elongate graspable body.

17. The double needle threader of claim 16, wherein said ridges adjoin said threading ledges and extend upwardly adjoining said thickened portion.

18. The double needle threader of claim 1, wherein a pair of cutting notches are formed in each end of said elongate graspable body, said notches having cutting blades disposed therein.

19. The double needle threader of claim 18, wherein said blades are recessed in said cutting notches such that a human finger pressed against said cutting notch will not contact said blade.

20. The double needle threader of claim 16, wherein said cutting notches each have a width less than about 3 mm whilst said blade is spaced away from said periphery by a distance of at least 3 mm.

* * * * *